US007501762B2

(12) United States Patent
Okumura et al.

(10) Patent No.: US 7,501,762 B2
(45) Date of Patent: Mar. 10, 2009

(54) PLASMA DISPLAY PANEL AND PROCESS FOR PRODUCING THE SAME

(75) Inventors: Tomohiro Okumura, Osaka (JP); Hiroyuki Yamakita, Osaka (JP); Noriyasu Echigo, Hyogo (JP); Mitsuo Saitoh, Osaka (JP); Junko Asayama, Osaka (JP); Keisuke Okada, Osaka (JP)

(73) Assignee: Panasonic Corporation, Osaka (JP)

( * ) Notice: Subject to any disclaimer, the term of this patent is extended or adjusted under 35 U.S.C. 154(b) by 371 days.

(21) Appl. No.: 11/484,590

(22) Filed: Jul. 12, 2006

(65) Prior Publication Data

US 2007/0013312 A1 Jan. 18, 2007

(30) Foreign Application Priority Data

Jul. 13, 2005 (JP) ..... 2005-204153

(51) Int. Cl.
*H01J 17/49* (2006.01)

(52) U.S. Cl. ..... 313/586; 313/587

(58) Field of Classification Search ..... None
See application file for complete search history.

(56) References Cited

U.S. PATENT DOCUMENTS 5,838,106 A * 11/1998 Funada ..... 313/587
6,066,917 A * 5/2000 Funada ..... 313/587
6,160,345 A 12/2000 Tanaka et al.
6,419,540 B1 7/2002 Tanaka et al.
6,611,099 B1 * 8/2003 Murata et al. ..... 313/582
6,753,649 B1 * 6/2004 Bechtel et al. ..... 313/587
6,761,608 B2 7/2004 Tanaka et al.
7,391,156 B2 * 6/2008 Hasegawa et al. ..... 313/587

FOREIGN PATENT DOCUMENTS

| | | |
|---|---|---|
| JP | 11-54051 | 2/1999 |
| JP | 11-195382 | 7/1999 |
| JP | 2000-156168 | 6/2000 |
| JP | 2002-358894 | 12/2002 |
| JP | 2003-7217 | 1/2003 |

* cited by examiner

*Primary Examiner*—Ashok Patel
(74) *Attorney, Agent, or Firm*—Wenderoth, Lind & Ponack, L.L.P.

(57) ABSTRACT

There are provided a PDP having a higher luminous efficiency and a process for producing the same. In a plasma display panel filled with a discharge gas between a front plate and a rear plate opposed to each other, the front plate 100 comprises a glass substrate 1, electrodes 2 (transparent electrodes 2*a* and bus electrodes 2*b*) on the glass substrate 1, the first dielectric layer 4 covering the electrodes 2 and the glass substrate 1 and containing a fluorine atom, the second dielectric layer 5 covering the first dielectric layer 4 and containing a fluorine atom at a less amount than that in the first dielectric layer 4, and a protective layer 6 covering the second dielectric layer 5.

5 Claims, 6 Drawing Sheets

PLASMA DISPLAY PANEL AND PROCESS FOR PRODUCING THE SAME

CROSS-REFERENCE TO RELATED APPLICATIONS

The present application claims a priority under 35 U.S.C. §119 to Japanese Patent Application No. 2005-204153 filed on Jul. 13, 2005, entitled "PLASMA DISPLAY PANEL AND PROCESS FOR PRODUCING THE SAME." The contents of this application are incorporated herein by reference thereto in their entirety.

BACKGROUND OF THE INVENTION

1. Field of the Invention

The present invention relates to a plasma display panel (hereinafter also referred to in this specification as a PDP, simply) and a process for producing the same.

2. Description of Related Art

A PDP is well known as one of flat panel displays used for displaying images on a television set, a computer or the like. As an example, a general structure of a surface discharge type PDP with three electrodes is shown in FIG. 10. This PDP has a front plate 50 and a rear plate 60 which are opposed to each other (FIG. 10 shows an exploded view of the PDP while the front plate 50 and the rear plate 60 are located apart so that the internal structure of the PDP can be readily understood). The front plate 50 is made by forming on a glass substrate 51, parallel display electrodes 52 in pairs, a dielectric layer 53, and a protective layer 54, successively. The display electrode 52 is generally composed of a transparent electrode 52*a* and a bus electrode 52*b*. In the rear plate 60, on the other hand, address electrodes 62 perpendicular to the display electrodes 52 and ribs 63 locating between the address electrodes 62 are formed on a glass substrate 61, and phosphor layers 64*a*, 64*b*, 64*c* respectively emitting a light of red color (R), green color (G), and blue color (B) are applied to regions between the ribs 63. The front plate 50 and the rear plate 60 are disposed to be opposed to each other, and a space formed therebetween is filled with a discharge gas. The space filled with the discharge gas is a discharge space, and a discharge cell is formed at each of intersections of the display electrodes 52 and the address electrodes 62. A voltage is applied between a certain pair of the display electrode 52 and the address electrode 62 to cause address discharge, and therefore to accumulate wall charge in a certain cell. Then, a voltage is applied between a pair of display electrodes 52 to cause display discharge at the cell where the wall charge is accumulated, so that an ultraviolet ray is generated from the discharge gas. This ultraviolet ray irradiates to the phosphorous layers 64*a*, 64*b*, and 64*c* to realize the displaying of a color image.

It is generally desirable that the PDP has a higher luminous efficiency. For obtaining a higher luminous efficiency it is supposed that a discharge voltage of surface discharge (display discharge) is decreased to increase a power efficiency of the surface discharge, and for achieving this it is effective to increase an electric field intensity at a surface of the dielectric layer 53 of the front panel 50. As one of such measures, it is supposed to reduce a thickness of the dielectric layer 53 which covers the display electrodes 52. This measure has an additional advantage that a capacitance between the display electrodes 52 can be ensured even when an area of the discharge cell becomes smaller with a movement towards finer discharge cells.

It is hitherto general to use a glass material based on a lead oxide or a bismuth oxide as the dielectric layer. However, such dielectric layer may cause various problems when it is simply made to be thinner. For example, on forming the dielectric layer, particles are incorporated therein or gas bubbles generated therein, so that a withstand voltage of the dielectric layer may decrease or a transparency of the dielectric layer may decrease.

In order to avoid such problems, it is proposed to divide the dielectric layer into two layers, and to form these layers with different materials from each other. More specifically, as shown in FIG. 11, the first dielectric layer 53*a* is formed on the glass substrate 51 and the display electrodes 52 to cover them, and thereafter the second dielectric layer 53*b* covering the first dielectric layer 53*a* and consisting of a material different from the first dielectric layer is formed, and the protective layer 54 is formed on the second dielectric layer 53*b*, so that the front panel is prepared.

Such two-layered dielectric layer is disclosed in, for example, Japanese Patent Kokai Publication No. H11-195382. In this publication, the first dielectric layer is a layer of $SiO_2$ formed by thermal decomposition of polysilazane in the atmospheric air, and the second dielectric layer is a layer of $SiO_2$, $Al_2O_3$, or a compound of $SiO_2$ and $Al_2O_3$ formed by a chemical vapor deposition (CVD) method. This publication also discloses that the second dielectric layer is a dielectric glass layer, which is prepared by firing.

In Japanese Patent Kokai Publication Nos. 2000-156168 and 2002-358894, the latter of which is a divisional application the former, the first dielectric layer is a dielectric glass layer of a high softening point, and the second dielectric layer is a dielectric glass layer of a low softening point, both prepared by firing.

In Japanese Patent Kokai Publication Nos. H11-54051 and 2003-7217, the latter of which is a divisional application the former, the first dielectric layer is a metal oxide layer (forming hydroxyl groups on its surface) obtained by a CVD method, and the second dielectric layer is a layer of a glass material based on a lead oxide or a bismuth oxide (having a permittivity not smaller than 10).

SUMMARY OF THE INVENTION

The conventional PDPs as described above are, however, not completely satisfactory.

As to the construction disclosed in, for example, Japanese Patent Kokai Publication No. H11-195382, since the layer of $SiO_2$, $Al_2O_3$, or a compound of $SiO_2$ and $Al_2O_3$ as the second dielectric layer is formed by the CVD method, the dielectric material such as $SiO_2$ is also deposited on and adheres to an inner wall of a CVD chamber. In a continuous production process, during the formation of the second dielectric layer by the CVD method, the deposit on the inner wall of the CVD chamber comes off therefrom and generates particles, and such particles are incorporated as a foreign substance into the dielectric layer. As a result, a film quality such as a withstand voltage may be remarkably degraded. In order to prevent this, it is necessary to remove the deposit accumulated on the inner wall of the CVD chamber (i.e. cleaning) by generating plasma from a fluorine atom-containing gas in the CVD chamber before the CVD method is conducted. However, a fluorine atom-containing substance is deposited on and adheres to the inner wall of the CVD chamber, so that fluorine atoms fly out of the fluorine atom-containing deposit (e.g. a thin film) and are incorporated into the second dielectric layer. The fluorine atoms in the second dielectric layer may diffuse into the protective layer which is formed to contact with the second dielectric layer. The protective layer is generally made of MgO, and the fluorine atoms would degrade characteristics of such protective layer and cause problems of increase of the discharge voltage and increase of variation in a delay time of the discharge.

This Japanese Patent Kokai Publication No. H11-195382 also discloses the dielectric glass layer as the second dielectric layer. However, the dielectric grass layer prepared by firing is not preferable since its withstand voltage is generally lower than that of a layer prepared by a CVD method. This is also applicable to the construction disclosed in Japanese Patent Kokai Publication Nos. 2000-156168 and 2002-358894 where the two dielectric glass layers having a different softening point from each other are used.

As to the construction disclosed in Japanese Patent Kokai Publication Nos. H11-54051 and 2003-7217, since the metal oxide layer forming hydroxyl groups on its surface is formed as the first dielectric layer by the CVD method, there is the problem of degradation of the film quality such as a withstand voltage due to incorporation of particles similarly to the above. When the cleaning, which generates plasma from a fluorine atom-containing gas in the CVD chamber, is conducted as described above in order to prevent this problem, fluorine atoms are incorporated into the first dielectric layer. Since the dielectric glass layer as the second dielectric layer is relatively porous and contains gas bubbles, the fluorine atoms in the first dielectric layer may pass through the second dielectric layer and diffuse into the protective layer. Then, similarly to the above, the fluorine atoms would degrade characteristics of the protective layer and cause problems of increase of the discharge voltage and increase of variation in a delay time of the discharge.

The purpose of the present invention is provide a PDP having a higher luminous efficiency without the conventional problems as described above, and a process for producing such PDP.

According to one aspect of the present invention, there is provided a PDP filled with a discharge gas between a front plate and a rear plate opposed to each other, wherein the front plate comprises:

a glass substrate;

electrodes on the glass substrate;

a first dielectric layer covering the electrodes and the glass substrate and containing a fluorine atom(s);

a second dielectric layer covering the first dielectric layer and containing a fluorine atom(s) at a less amount (or concentration) than that in the first dielectric layer; and a protective layer covering the second dielectric layer.

Since the PDP of the present invention is provided with the first dielectric layer containing a fluorine atom(s), a relative permittivity of the first dielectric layer can be reduced by a high electronegativity of the fluorine atom, and therefore a certain electric capacitance between the display electrodes as to the first dielectric layer can be obtained with a thinner thickness. As a result, the total thickness of the first and the second dielectric layers can be made thinner to decrease the discharge voltage, so that it becomes possible to provide the PDP with a higher luminous efficiency.

Further, since the PDP of the present invention is provided with the second dielectric layer between the first dielectric layer and the protective layer, the first dielectric layer does not contact with the protective layer, directly. This second dielectric layer is in a condition of containing a fluorine atom(s) at a less amount than that in the first dielectric layer, so that the fluorine atom(s) in the first dielectric layer has not been diffused through the second dielectric layer. Thus, the second dielectric layer functions as a barrier against the fluorine atom(s) between the first dielectric layer and the protective layer, and it becomes possible to substantially avoid the problems caused by the bad influence of the fluorine atom to the protective layer generally made of MgO, such as increase of the discharge voltage and increase of variation in a delay time of the discharge.

In the context of the present invention, the phrase "the second dielectric layer . . . containing a fluorine atom at a less amount than that in the first dielectric layer" means that a fluorine atom content (or concentration) in the second dielectric layer is less than a fluorine atom content (or concentration) in the first dielectric layer, and also comprises that the second dielectric layer contains no fluorine atom. The smaller fluorine atom content (or concentration) in the second dielectric layer the more preferable it becomes, and the most preferably it contains substantially no fluorine atom, while not limiting the present invention.

In a preferable embodiment of the present invention, the first dielectric layer further contains water. A transparent conductive oxide (such as indium tin oxide, zinc oxide and so on) which is generally used as a material of the electrodes (more specifically, transparent electrodes) of the front plate tends to decrease in its resistance under the influence of the water. As a result, the conductivity of the electrodes can be increased, so that it becomes possible to provide the PDP with a higher luminous efficiency. Also, the second dielectric layer may contain water. The smaller water content (or concentration) in the second dielectric layer the more preferable it becomes, and the most preferably it contains substantially no water, while not limiting the present invention.

In one embodiment of the present invention, each of the first dielectric layer and the second dielectric layer is mainly composed of silicon and oxygen atoms, and more specifically, the total of the silicon and oxygen atoms accounts for 90% or more of constituent elements of each layer. Such layer can mainly consist of, for example, silicon oxide and can be formed stably at a low cost by applying a silicon oxide-forming technique known in the art (comprising a CVD method and a PVD method).

With respect to the PDP of the present invention, when each of the first and the second dielectric layers contains silicon and oxygen atoms, a fluorine atom content in each of the layers can be estimated by using as a measure a ratio $R_1$ of an intensity of an Si—F bond to that of an Si—O bond obtained by Fourier transform infrared spectrophotometer (FTIR). A value of the $R_1$ for the first dielectric layer is, for example, not smaller than 0.2 and not greater than 5, and a value of the $R_1$ for the second dielectric layer is, for example, smaller than 0.2. In the context of the present invention, the "intensity" means a peak intensity measured for a certain bond by the Fourier transform infrared spectrophotometer.

A water content in each of the first and the second dielectric layers can be estimated by using as a measure a degassing volume of water molecules obtained by Thermal desorption spectroscopy (TDS). A ratio $R_2$ of the degassing volume of the first dielectric layer to that of the second dielectric layer is, for example, not smaller than about 10 and not greater than about 1000. In the context of the present invention, the thermal desorption spectroscopy is conducted so as to measure a total volume of a gas which is released from each layer by increasing a temperature from a normal temperature (e.g. 25° C.±10° C.) to 500° C. under a normal pressure (about 0.1 MPa), and has a mass corresponding to a water molecule ($H_2O$, mass number 18).

According to another aspect of the present invention, there is provided a process for producing a plasma display panel filled with a discharge gas between a front plate and a rear plate opposed to each other, wherein the front plate is produced by following steps of:

(a) forming a first dielectric layer on a glass substrate and electrodes formed thereon by a chemical vapor deposition (CVD) method under a first atmosphere containing a fluorine atom(s);

(b) forming a second dielectric layer on the first dielectric layer by a physical vapor deposition (PVD) method so as to contain a fluorine atom(s) at a less amount than that in the first dielectric layer; and (c) forming a protective layer which covers the second dielectric layer.

In the process for producing a PDP of the present invention, since the first dielectric layer is formed by the chemical vapor deposition method under the first atmosphere containing a fluorine atom(s), the obtained first dielectric layer contains the fluorine atom(s). Due to application of the chemical vapor deposition, a higher withstand voltage can be obtained compared with a dielectric layer which is prepared by firing. While not limiting the present invention, the chemical vapor deposition is preferably a plasma enhanced chemical vapor deposition (PECVD, or plasma CVD) method. Such chemical vapor deposition makes it possible to form the first dielectric layer stably at a low cost.

In the process for producing a PDP of the present invention, the second dielectric layer is formed by the physical vapor deposition method such that it contains a fluorine atom(s) at a less amount than that in the first dielectric layer. Since the deposit generated by the physical vapor deposition method is not present all over a chamber as in the chemical vapor deposition method but limited on only a periphery of the substrate, generation of particles can be readily prevented by using a shield or the like. Thus, the cleaning of the chamber for avoiding the generation of particles is almost unnecessary, and even if needed its frequency is very low. Therefore, this can substantially solve the problems of degradation of the film quality such as a withstand voltage due to incorporation of the particles, and of degradation of characteristics of the protective layer due to incorporation of the fluorine atom into the second dielectric layer. While not limiting the present invention, the physical vapor deposition method is preferably a sputtering method or an electron-beam evaporation method, but it may be a thermal deposition, a laser deposition or the like. Such physical vapor deposition makes it possible to decrease a permeability of the second dielectric layer to the fluorine atom, and thus effectively realize the function of the second dielectric layer as a barrier.

This process for producing a PDP of the present invention can produce the PDP of the present invention described above, and provides effects similar to that PDP.

The chemical vapor deposition method, preferably the plasma enhanced chemical vapor deposition method, in the step (a) can be conducted by using for the first atmosphere at least one of fluorine atom-containing gases, for example, selected from the group consisting of fluorinated hydrocarbons, $SF_6$ and $NF_3$. The term "fluorinated hydrocarbons" throughout the present invention means alkanes, alkenes, or alkynes which have at least one fluorine atom. The fluorinated hydrocarbons preferably has a carbon number not greater than 5, and may comprise, for example, $CF_4$, $CHF_3$, $CH_2F_2$, $CH_3F$, $C_2F_6$, $C_3F_6$, $C_4F_8$, $C_5F_8$ and so on.

The producing process of the present invention may further comprise prior to the step (a), a preparatory step of generating plasma from at least one fluorine atom-containing gas selected from the group consisting of the fluorinated hydrocarbons, $SF_6$ and $NF_3$ in a space for conducting the step (a) (i.e. the CVD chamber). This preparatory step causes that a fluorine atom-containing substance is deposited on and adheres to an inner wall of the CVD chamber, and during the following step (a) the fluorine atoms fly out of the deposit to form the first atmosphere containing the fluorine atoms in the CVD chamber, and they are incorporated in the first dielectric layer. If the fluorine atom content in the first dielectric layer is not required to be so high and sufficient by only the fluorine atoms flying out of the deposit and being incorporated into the first dielectric layer, the fluorine atom-containing gas described above may not be used in the step (a). In such case, the preparatory step can be understood as a step for preparing the first atmosphere containing the fluorine atoms. The preparatory step can also be understood as a step for cleaning the CVD chamber, and can remove the dielectric substance which would be accumulated in the CVD chamber in the continuous production process.

In one embodiment of the present invention, the above process may further comprise a step of locating the substrate obtained by the step (a), before being subjected to the step (b), under a second atmosphere containing moisture to expose the first dielectric layer to the second atmosphere. Since the fluorine atom has a hygroscopicity, this exposing step incorporates the water into the first dielectric layer. Therefore, the first dielectric layer is formed to contain both of the fluorine atom and the water. However, the present invention is not limited to this, and the first atmosphere in the step (a) may contain water so that the first dielectric layer contains water.

As described above, according to the present invention, there can be provided the PDP having a higher luminous efficiency without the conventional problems, as well as the process for producing the PDP. The PDP of the present invention is useful for, but not limited to, a display apparatus for displaying images on a television set, a computer and so on.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF THE INVENTION

Figure 10:
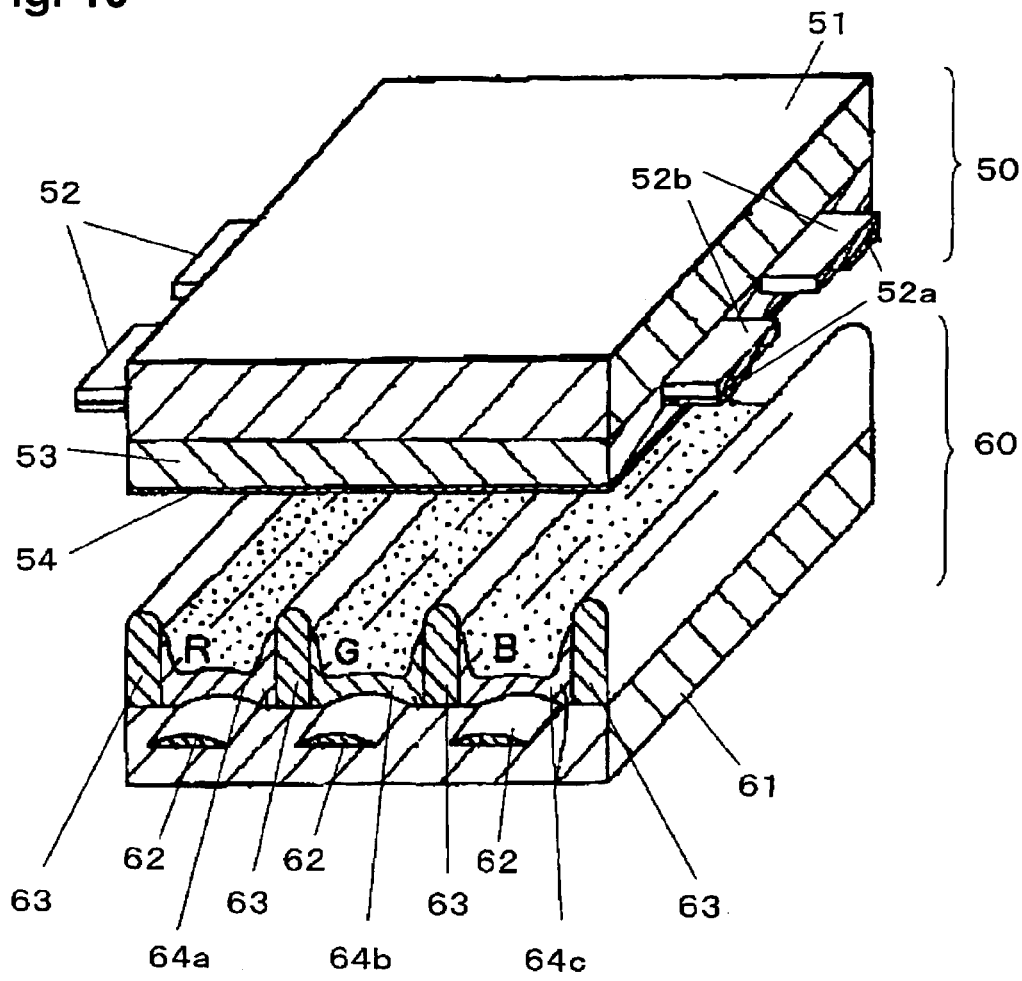
FIG. 10 schematically shows an exploded partial perspective view of a conventional and typical PDP.
Figure 11:
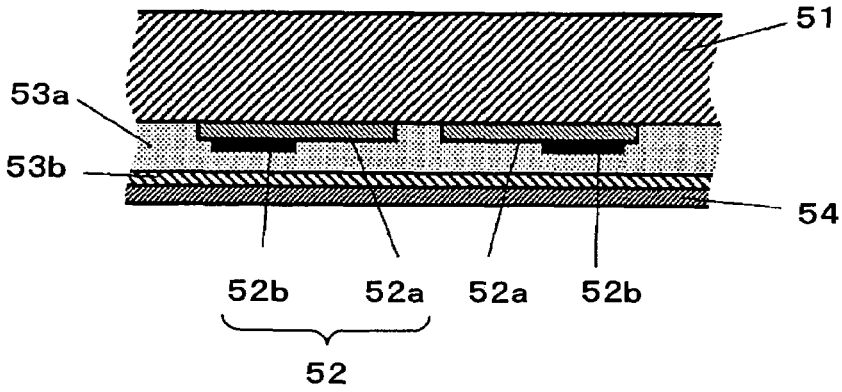
FIG. 11 schematically shows a cross-sectional view of a front plate of the conventional PDP.

Hereinafter, some embodiments of the present invention will be described in detail with reference to the drawings. Please note that the following embodiments are described mainly about characteristic parts of the present invention, and any appropriate structure and producing process including those described above with reference to FIG. 10 can be applied to the present invention excepting a dielectric layer unless otherwise specified.

First Embodiment

This embodiment relates to an embodiment in which the first dielectric layer contains a fluorine atom(s) and water and this first dielectric layer is formed by the first atmosphere containing fluorine atoms in the form of a fluorine atom-containing gas and the second atmosphere containing moisture.

Figure 1:
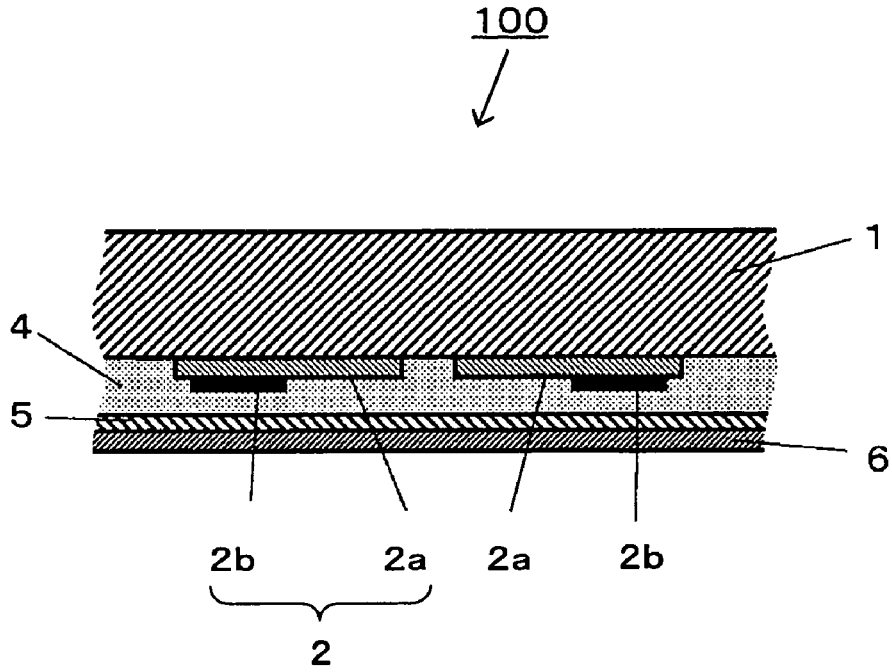
FIG. 1 schematically shows a cross-sectional view of a front plate of a PDP in one embodiment of the present invention.

As shown in FIG. 1, a front plate 100 of a PDP of this embodiment is constructed by locating display electrodes 2 on a glass substrate 1 (at an inner side of the PDP, i.e. a lower side in FIG. 1). The display electrodes 2 are in a pair and parallel to each other, and each of the display electrodes 2 is composed of a transparent electrode 2*a* and a bus electrode 2*b*. The transparent electrode 2*a* may consist of indium tin oxide (ITO), but may consist of other transparent conductive oxide such as zinc oxide (ZnO). The bus electrode 2*b* may generally consist of an opaque metal such as Cu or Ag. Further, the first dielectric layer 4 covering the glass substrate 1 and the display electrodes 2 is located, and the second dielectric layer 5 and a protective layer 6 are located on the first dielectric layer 4 in this order. The protective layer consists of magnesium oxide (MgO).

The first dielectric layer 4 and the second dielectric layer 5 are composed so that a silicon atom (Si) and a oxygen atom (O) accounts for 90% or more of constituent elements of each layer, and they can be formed stably with a low cost by a method described hereinafter. More specifically, the first dielectric layer 4 consists of silicon oxide containing fluorine atoms (F) and water, and has a relative permittivity of about 3.5 to 4.0. The second dielectric layer 5 consists of silicon oxide containing substantially no fluorine atom (F) and substantially no water, and has a relative permittivity of about 4.3 to 4.7. The reason why the relative permittivity of the first dielectric layer 4 is higher than that of the second dielectric layer 5 is an effect of the fluorine atom as described hereinafter. The water in the first dielectric layer 4 (and if present the second dielectric layer 5) may be in the form of a water molecule ($H_2O$) or in an ionization state ($H^+$ and $OH^-$). The first dielectric layer 4 and the second dielectric layer 5 are substantially transparent (in other words, permeable to a visible light) and exhibit an excellent electrical insulation. Contents of the fluorine atom and the water in each of the first dielectric layer 4 and the second dielectric layer 5, and thicknesses thereof will be described hereinafter.

This front plate 100 can be produced as follows. At first, an ITO film is formed on the glass plate 1 by, for example, a sputtering method, and then the ITO film is patterned by a photolithography method to form the transparent electrodes 2*a*. Next, a photosensitive and conductive paste containing metal particles is applied onto the transparent electrodes 2*a* into a film, and then the applied film is patterned by a photolithography method to form bus electrodes 2*b*. Alternatively, it is also acceptable that a metal thin film is formed on the transparent electrodes 2*a* by, for example, a sputtering method, and then the metal thin film is patterned by a photolithography method to form the bus electrodes 2*b*. Thus, the display electrodes 2 each composed of the transparent electrode 2*a* and the bus electrode 2*b* are obtained. A thickness and width of each of the transparent electrode 2*a* and the bus electrode 2*b*, a distance between the transparent electrodes 2*a*, a positional relationship between the transparent electrode 2*a* and the bus electrode 2*b*, and so on may be selected appropriately and arbitrarily.

A base layer (or precursor layer) for the first dielectric layer 4 is formed by a CVD method under the first atmosphere to cover a whole of a PDP inner surface of thus obtained substrate, i.e. an exposed surface area of the glass substrate 1 and the display electrodes 2 (the transparent electrodes 2*a* and the bus electrodes 2*b*).

Figure 2:
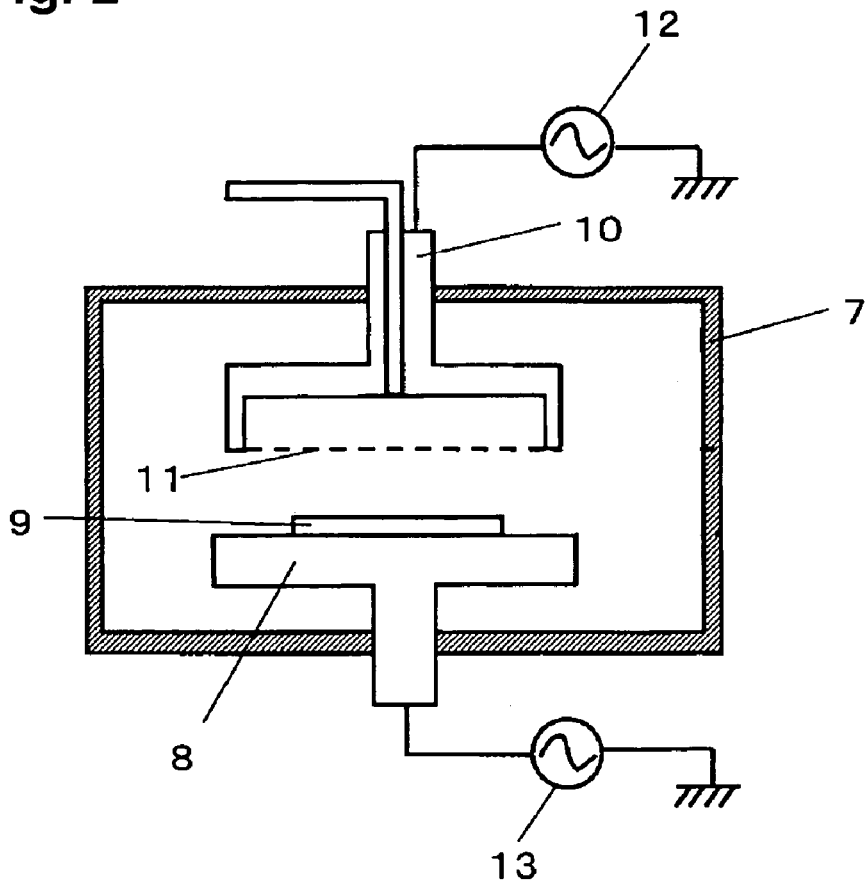
FIG. 2 schematically shows a cross-sectional view of a low pressure plasma CVD apparatus which can be used for forming the first dielectric layer in the process for producing the PDP of FIG. 1.

The base layer can be formed by using a low pressure plasma CVD apparatus as shown in FIG. 2. The substrate 9 on which the display electrodes are formed as described above is located on a lower electrode 8 in a vacuum vessel (the CVD chamber) 7 under vacuum, wherein the side of the glass substrate 1 on which the display electrodes 2 are formed (the PDP inner side, both not shown in FIG. 2) is set as an upside. While gases of TEOS (tetraethylorthosilicate; which is also referred to as tetraethoxysilane or ethilsilicate, and expressed by a chemical formula of $Si(OC_2H_5)_4$), He, $C_2F_6$, and $O_2$ are supplied from a gas supplying apparatus (not shown) into the vacuum vessel 7 through a shower head 11 located under an upper electrode 10, the gases are evacuated by a pump and a pressure-controlling valve (both not shown) to keep a predetermined vacuum pressure in the vacuum vessel 7. Under this condition, a high frequency power supply 12 supplies the upper electrode 10 with a high frequency power (e.g. 13.56 MHz), and another high frequency power supply 13 supplies the lower electrode 8 with a high frequency power (e.g. 1 MHz). Accordingly, a film of silicon oxide which contains fluorine atoms (which is also referred to as fluorinated silicon oxide or fluorine added silicon oxide) is formed as the base layer on the substrate 9.

Figure 3:
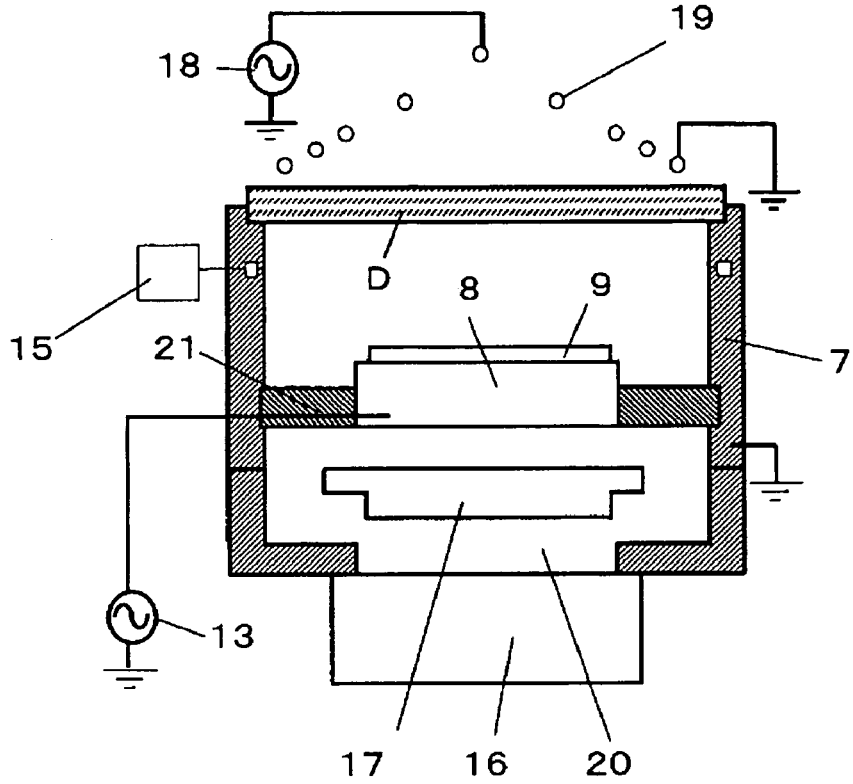
FIG. 3 schematically shows a cross-sectional view of an inductively coupled plasma CVD apparatus which can be used for forming the first dielectric layer in the process for producing the PDP of FIG. 1.

The base layer can also be formed by using an inductively coupled plasma (ICP) CVD apparatus as shown in FIG. 3. The substrate 9 on which the display electrodes are formed as described above is located on a lower electrode 8 in a vacuum vessel (the CVD chamber) 7 under vacuum, wherein the side of the glass substrate 1 on which the display electrodes are formed (the PDP inner side, both not shown in FIG. 3) is set as an upside. The lower electrode 8 is fixed to the vacuum vessel 7 with posts 21. While gases of TEOS, He, $C_2F_6$, and $O_2$ are supplied from a gas supplying apparatus 15 into the vacuum vessel 7, the gases are evacuated through an exit port 20 by a pump 16 and a pressure-controlling valve 17 to keep a predetermined vacuum pressure in the vacuum vessel 7. Under this condition, a high frequency power supply 18 supplies a coil 19 located along a dielectric window D with a high frequency power (e.g. 13.56 MHz), and another high frequency power supply 13 supplies the lower electrode 8 with a high frequency power (e.g. 1 MHz). Accordingly, a film of fluorinated silicon oxide is formed as the base layer on the substrate 9. By using the ICP-CVD apparatus, it is possible to form the film of fluorinated silicon oxide which is more densified and chemically and physically stable compared with those obtained by other CVD apparatuses.

Figure 4:
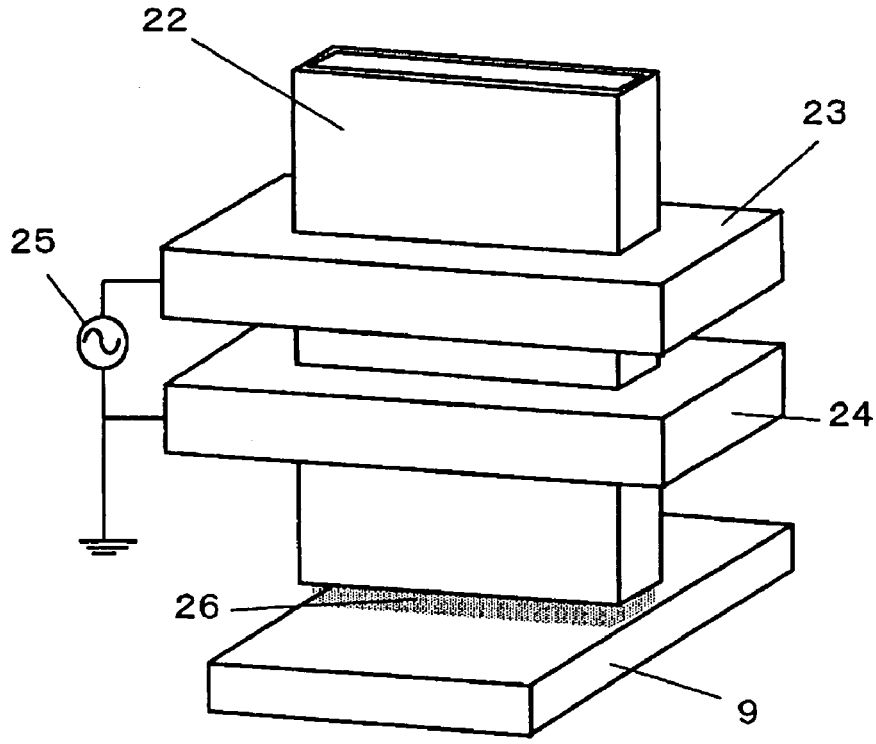
FIG. 4 schematically shows a cross-sectional view of an atmospheric pressure plasma CVD apparatus which can be used for forming the first dielectric layer in the process for producing the PDP of FIG. 1.

Further, the base layer can also be formed by using an atmospheric pressure plasma CVD apparatus as shown in FIG. 4. The substrate 9 on which the display electrodes are formed as described above is located under an atmospheric pressure such that the side of the glass substrate 1 on which the display electrodes are formed (the PDP inner side, both not shown in FIG. 4) faces one opening of a dielectric tube 22 (which corresponds to the CVD chamber). A high frequency electrode 23 and a ground electrode 24 are located on the periphery of the dielectric tube 22. Gases of TEOS, He, $C_2F_6$, and $O_2$ is supplied from the other opening of the dielectric tube 22 and evacuated through the one opening (that is, these gases go through the dielectric tube 22 from the top to the bottom in FIG. 4). Under this condition, a high frequency power supply 25 supplies the high frequency electrode 23 with a high frequency power (e.g. 13.56 MHz), so that atmospheric pressure plasma is generated in the dielectric tube 22 and a flow of active particles 26 obtained thereby ejects towards the surface of the substrate 9. Since the flow of active particles 26 contains a great amount of a film-forming precursor which is generated by decomposition of the raw gases, a film of fluorinated silicon oxide is formed as the base layer on the substrate 9. By using the atmospheric pressure plasma CVD apparatus, it is possible to form the film of fluorinated silicon oxide with a higher speed compared with other CVD apparatuses.

In the process using either CVD apparatus described above, the base layer is formed by the CVD method under the first atmosphere containing the fluorine atoms with the use of the fluorine atom-containing gas. It is noted that since the base layer contains the fluorine atoms, the base layer itself falls into "a first dielectric layer containing a fluorine atom." Although this embodiment provides an example using the $C_2F_6$ gas as the fluorine atom-containing gas, other fluorine atom-containing gas(es) such as other fluorinated hydrocarbons of $CF_4$, $CHF_3$, $CH_2F_2$, $CH_3F$, $C_3F_6$, $C_4F_8$, and $C_5F_8$, or $SF_6$, $NF_3$, or the like may be used.

After forming the base layer for the first dielectric layer 4, thus obtained substrate is exposed to the second atmosphere containing moisture, e.g. an atmospheric air containing water vapor, so that the base layer contacts with the second atmosphere. Due to a hygroscopicity of the fluorine atoms contained in the base layer, the moisture in the second atmosphere intrudes into the base layer in a small amount. The hygroscopicity of the base layer is attributable to not only the fluorine atoms, but it is significantly large when the TEOS is used as the Si source for the plasma CVD method (i.e. plasma TEOS). Thus, the first dielectric layer 4 containing both of the fluorine atoms and the water is formed.

After forming the first dielectric layer 4 as described above, the second dielectric layer 5 containing substantially no fluorine atom and substantially no water is formed on the whole of the first dielectric layer 4 by a PVD method.

Figure 5:
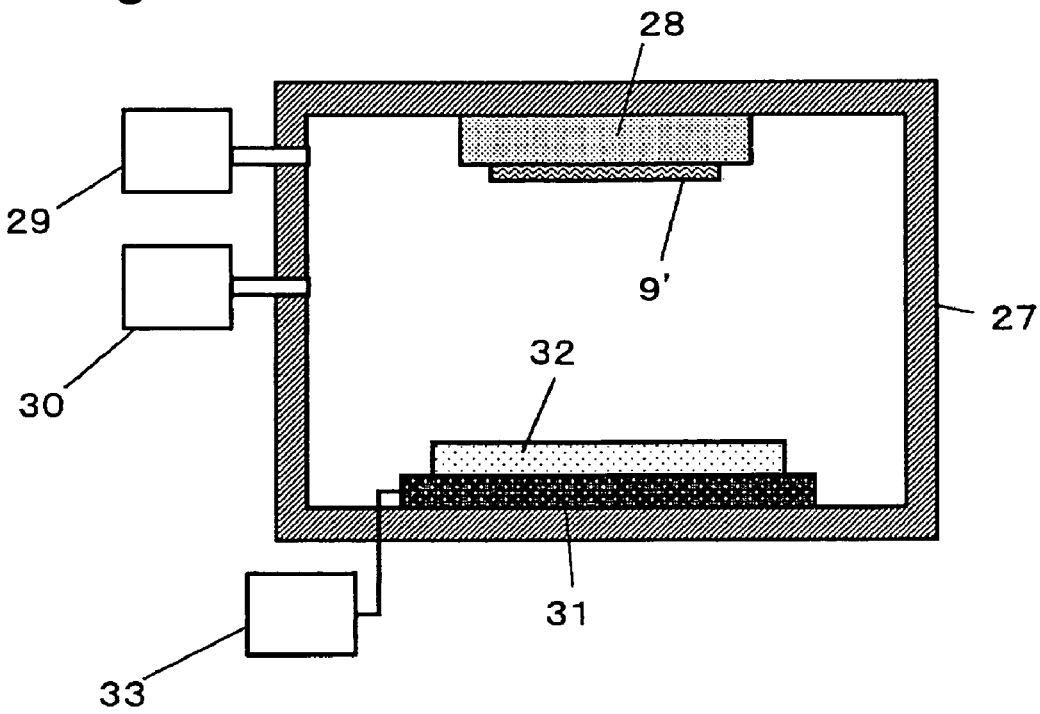
FIG. 5 schematically shows a cross-sectional view of a sputtering apparatus which can be used for forming the second dielectric layer in the process for producing the PDP of FIG. 1.

The second dielectric layer 5 can be formed by using a sputtering apparatus as shown in FIG. 5. The substrate 9' on which the first dielectric layer 4 is formed as described above is mounted on a substrate holder 28 in a vacuum vessel (the CVD chamber) 27 under vacuum, wherein the side of the glass substrate 1 on which the display electrodes 2 are formed (the PDP inner side, both not shown in FIG. 5) is set to oppose a target 32 of silicon oxide. While an Ar gas is supplied from a gas supplying apparatus 29 into the vacuum vessel 27, the gas is evacuated by a pump 30 and a pressure-controlling valve (not shown) to keep a predetermined vacuum pressure in the vacuum vessel 27. Under this condition, a high frequency power supply 33 supplies a backing plate 31 and the target 32 bonded thereto with a high frequency power (e.g. 13.56 MHz). As a result, plasma is generated at the surface of the target 32, and silicon oxide of the target 32 is sputtered, so that a silicon oxide film is formed as the second dielectric layer 5 to cover the surface of the substrate 9' (i.e. the first dielectric layer 4).

Although the above shows an example using the silicon oxide for the target 32 in the atmosphere of the Ar gas, it is also possible to form the silicon oxide film by a reactive sputtering while using silicon for the target and using an $O_2$ gas in addition to the Ar gas.

Figure 6:
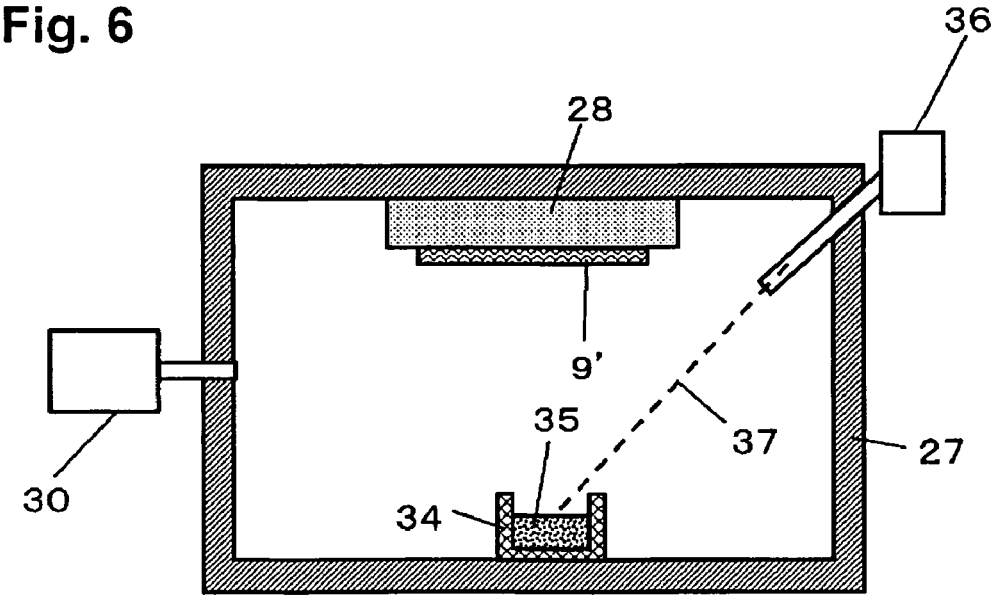
FIG. 6 schematically shows a cross-sectional view of an electron-beam evaporation apparatus which can be used for forming the second dielectric layer in the process for producing the PDP of FIG. 1.

The second dielectric layer 5 can also be formed by using an electron-beam evaporation apparatus as shown in FIG. 6. The substrate 9' on which the first dielectric layer 4 is formed as described above is mounted on a substrate holder 28 in a vacuum vessel (the CVD chamber) 27 under vacuum formed by a pump 30, wherein the side of the glass substrate 1 on which the display electrodes 2 are formed (the PDP inner side, both not shown in FIG. 6) is set to oppose an evaporation source 35 of silicon oxide (in the form of pellets). Under a condition keeping a predetermined vacuum pressure in the vacuum vessel 27, an electron-beam supply 36 irradiates the evaporation source 35 in a crucible 34 with an electron beam 37. As a result, silicon oxide of the evaporation source 35 evaporates by heating, so that a silicon oxide film is formed as the second dielectric layer 5 to cover the surface of the substrate 9' (i.e. the first dielectric layer 4).

After forming the second dielectric layer 5 as described above, the protective layer 6 is formed on the whole of the second dielectric layer 5. The protective layer 6 is obtained to form a magnesium oxide (MgO) film by using a PVD method such as a sputtering method or an electron-beam evaporation method. The thickness of the protective layer is generally about 0.3 μm to 2 μm although it is selected in consideration of damage which may be inflicted on the protective layer 6 during operation of the PDP, a lifetime of the PDP, a time period required for forming the protective layer (cost) and so on.

Thus, the front panel 100 is formed. The obtained front panel 100 is positioned to oppose any appropriate rear plate such as that described with reference to FIG. 10, and a discharge gas is inserted into a space formed therebetween. Thus, the PDP of this embodiment is produced. In general, a rare gas such as Xe, Ne, He, and a mixed gas of at least two of them may be used as the discharge gas.

As to the PDP of this embodiment, the first dielectric layer 4 and the second dielectric layer 5 are mainly composed of silicon oxide, the first dielectric layer 4 is further comprises the fluorine atoms and the water while the second dielectric layer contains substantially no fluorine atom and substantially no water. The fluorine atoms contained in the first dielectric layer 4 functions to decrease a relative permittivity of the first dielectric layer 4. The larger the fluorine atom content of the first dielectric layer 4 becomes, the more the relative permittivity can be decreased. This is supposed to be attributed to a high electronegativity of the fluorine atom. When a predetermined electric capacitance between the display electrodes should be achieved, the lower the relative permittivity, the smaller the thickness of the dielectric layer. Therefore, it becomes possible by the dielectric layer having the lower relative permittivity to realize the PDP having a smaller discharge voltage, and thus a higher luminous efficiency.

Figure 7:
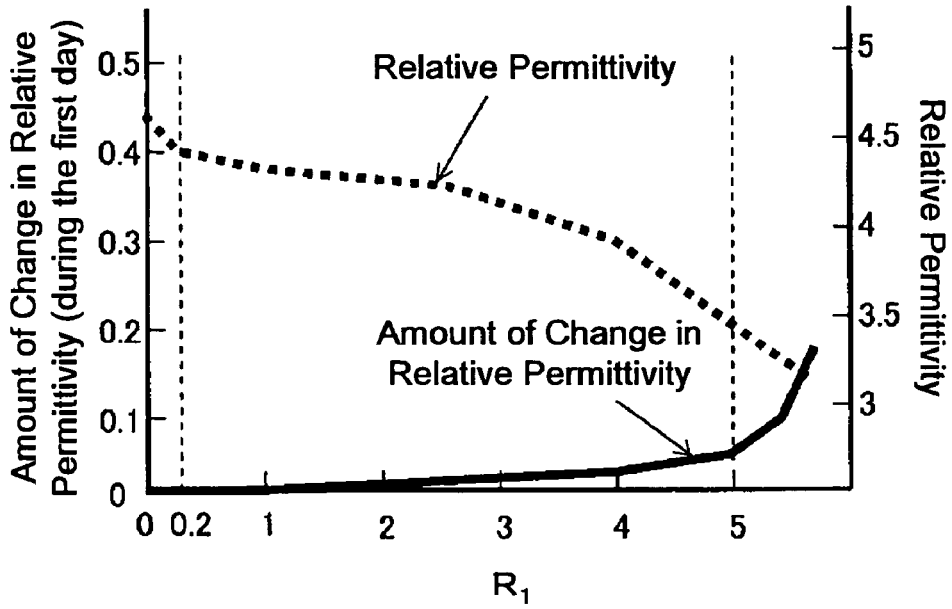
FIG. 7 is a graph showing relations of a relative permittivity and an amount of change in the relative permittivity (during the first day) to a fluorine atom content measure $R_1$ of a dielectric layer of fluorinated silicon oxide (a ratio of an intensity of an Si—F bond to that of an Si—O bond by Fourier transform infrared spectrophotometer)

However, if the fluorine atom content of the first dielectric layer 4 is too high, a change of the relative permittivity with time can not be negligible. It is supposed that this is attributed to a hygroscopicity of the fluorine atom, and that more amount of the fluorine atoms absorbs more amount of the water into the first dielectric layer to change the relative permittivity with time more largely. FIG. 7 shows relations of the relative permittivity and the amount of change in the relative permittivity (during the first day) to a fluorine atom content measure $R_1$ of a dielectric layer of fluorinated silicon oxide. This dielectric layer of fluorinated silicon oxide is formed on a glass substrate by the plasma TEOS as similarly to the base layer describe above, and kept in an exposed condition to an atmospheric air containing water vapor. The dielectric layer of fluorinated silicon oxide which has absorbed water by the exposure corresponds to the first dielectric layer in this embodiment. The fluorine atom content measure $R_1$ is a ratio of an intensity of an Si—F bond to that of an Si—O bond obtained by FTIR as explained above. The relative permittivity is measurable based on a well known technique in the art, e.g. JIS (Japanese Industrial Standards). The amount of change in the relative permittivity (during the first day) is a value obtained by subtracting the relative permittivity of the dielectric layer of fluorinated silicon oxide when it is just formed, from the relative permittivity of the dielectric layer after the exposure of it to an atmospheric air for 24 hours. As understood from FIG. 7, the first dielectric layer 4 preferably has a value of $R_1$ which is not smaller than 0.2 and not greater than 5.

In contrast, the second dielectric layer contains substantially no fluorine atom and substantially no water not only at the time point of its formation but also thereafter. This is because the second dielectric layer 5 consisting of silicon oxide is formed by the PVD method, so that its permeability to the fluorine atom and the water is low. Such second dielectric layer 5 functions as a barrier against the fluorine atom and the water between the first dielectric layer 4 and the protective layer 6, and therefore it is effectively suppressed that the fluorine atoms and the water contained in the first dielectric layer 4 diffuse into the protective layer 6 through the second dielectric layer 5. Thus, the protective layer 6 consisting of MgO is free from the bad influence by the fluorine atoms, and thereby it becomes possible to substantially avoid the problems such as increase of the discharge voltage and increase of variation in a delay time of the discharge. Although the second dielectric layer 5 contains substantially no fluorine atom in this embodiment, the second dielectric layer 5 may contain fluorine atoms at a less amount than that in the first dielectric layer 4. The amount of the fluorine atoms in the second dielectric layer 5 is preferably at a degree with which the bad influence by the fluorine atoms on the protective layer 6 can be substantially negligible, and the second dielectric layer 5 preferably has a value of $R_1$ which is smaller than 0.2 (including the minimum measuring limit).

In addition, the water contained in the first dielectric layer 4 functions to decrease a resistance of the transparent electrode 2*a*. The larger the water content of the first dielectric layer 4 becomes, the more the resistance can be decreased. While not wishing to be bound by any theory, the reason of this is supposed as that a dangling bond of the transparent conductive oxide (e.g. ITO or ZnO) consisting the transparent electrode 2*a* is terminated with $H^+$ derived from the water, so that carriers will flow smoothly (on the other hand, $OH^-$ derived from the water may contribute to increase in its transparency). Therefore, it becomes possible by the higher conductivity of the electrode to form a larger potential difference between the electrodes (such as between the display electrodes in a pair or between the display electrode and the address electrode), and thereby to realize the PDP having a higher luminous efficiency.

Figure 8:
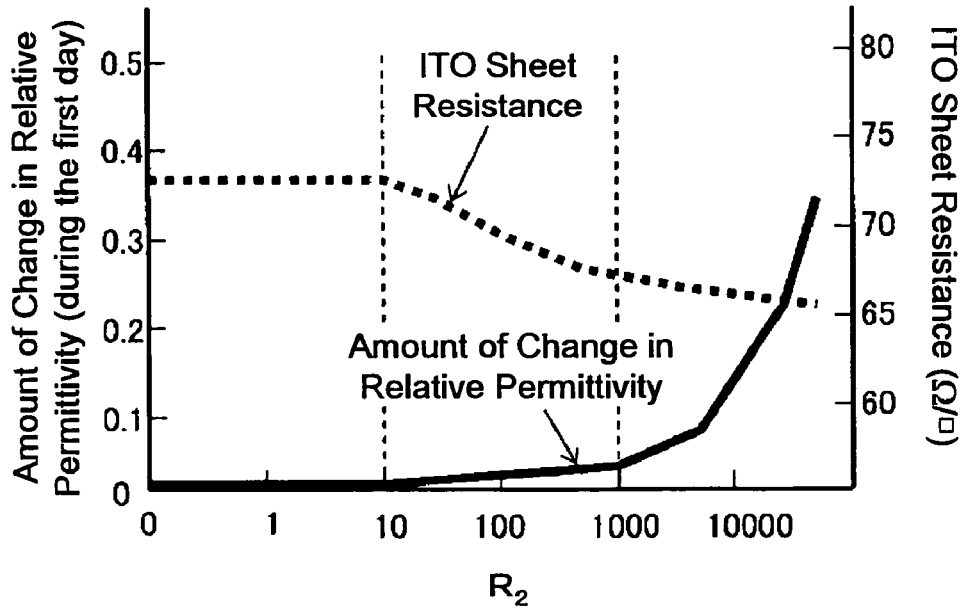
FIG. 8 is a graph showing relations of a sheet resistance of a transparent electrode (ITO) and an amount of change in a relative permittivity (during the first day) of the first dielectric layer of fluorinated silicon oxide to a water content ratio measure $R_2$ of the first dielectric layer to the second dielectric layer of silicon oxide (a ratio of a degassing volume of the first dielectric layer to that of the second dielectric layer by Thermal desorption spectroscopy)

However, if the water content of the first dielectric layer 4 is too high, a change of the relative permittivity of the first dielectric layer 4 with time can not be negligible. FIG. 8 shows relations of a sheet resistance of a transparent electrode (ITO) and an amount of change in a relative permittivity (during the first day) of the first dielectric layer of fluorinated silicon oxide to a water content ratio measure $R_2$ of the first dielectric layer to the second dielectric layer of silicon oxide. The transparent electrode (ITO), the first dielectric layer of fluorinated silicon oxide, and the second dielectric layer of silicon oxide are formed on a glass substrate as similarly to this embodiment, and in an example of FIG. 8 have a thickness of 50 nm, 20 μm, and 500 nm, respectively. The water content of the first dielectric layer can be controlled by a time period for exposing the base layer to an atmospheric air after forming it by the plasma TEOS. The water content of the second dielectric layer is extremely small in comparison with the first dielectric layer and supposed to be unchangeable with time. The water content ratio measure $R_2$ is a ratio of a degassing volume of water molecules of the first dielectric layer to that of the second dielectric layer by Thermal desorption spectroscopy as explained above. This degassing volume is the total volume of a gas which has a mass corresponding to a water molecule ($H_2O$, mass number 18) and released from the layer when the temperature is increased from a normal temperature (e.g. 25° C.±10° C.) to 500° C. under a normal pressure (about 0.1 MPa). The sheet resistance of the transparent electrode (ITO) is measured by forming contact holes through the first dielectric layer by a photolithography technique after forming the first dielectric layer to cover the transparent electrode and without forming the second dielectric layer, and then contacting the measuring probes with the transparent electrode according to a four-point probe method. The amount of change in the relative permittivity (during the first day) is a value obtained by subtracting the relative permittivity of the first dielectric layer of fluorinated silicon oxide when it is just formed, from the relative permittivity of the dielectric layer after the exposure of it to an atmospheric air for 24 hours without forming the second dielectric layer thereon. As understood from FIG. 8, a value of $R_2$ is preferably not smaller than about 10 and not greater than about 1000, since in such range there are provided effects of a small amount of change in the relative permittivity and a smaller sheet resistance of the transparent electrode.

Figure 9:
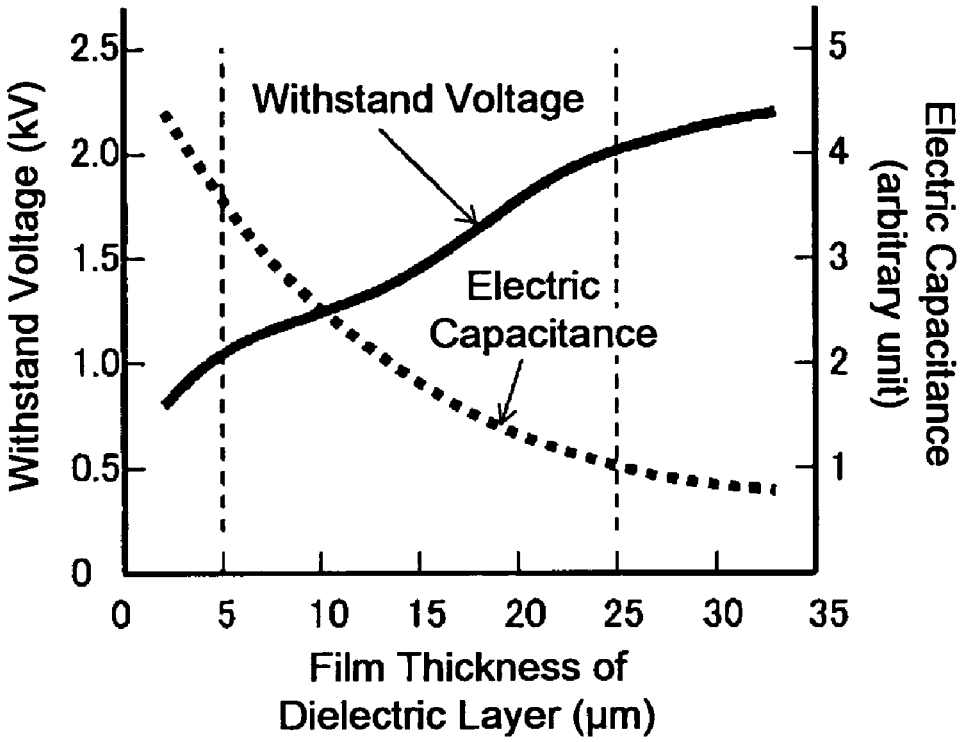
FIG. 9 is a graph showing relations of a withstand voltage of a dielectric layer of fluorinated silicon oxide which has absorbed water, and an electric capacitance between bus electrodes in the dielectric layer to a film thickness of the dielectric layer.

As to thicknesses of the first dielectric layer 4 and the second dielectric layer 5, it is necessary to consider various matters. At first, it is not preferable to make the second dielectric layer 5 relatively thick, which is formed by the PVD method. This is because in comparison with the film obtained by the CVD method, the film obtained by the PVD method has a lower strength of adhesion and a difficulty controlling its internal stress, so that the larger the film thickness becomes the more likely the film removes. However, if the second dielectric layer 5 is too thin, the fluorine atoms and the water readily diffuse into the protective layer 6 through it. Therefore, it is preferable that the second dielectric layer 5 is thick enough to suppress the permeation of the fluorine atoms and the water and as thin as possible to hard to remove. Such thickness of the second dielectric layer 5 is, for example, not smaller than 100 nm and preferably not smaller than 200 nm, and not greater than 5 μm and preferably not greater than 1 μm. Since the second dielectric layer is thin as above, it is necessary to make the first dielectric layer relatively thick in order to ensure the withstand voltage of the first and the second dielectric layers. Since the thickness of the first dielectric layer is fairly larger than that of the second dielectric layer, it is supposed that the withstand voltage of the first and the second dielectric layers and the electric capacitance between the bus electrodes depend on the thickness of the first dielectric layer. FIG. 9 shows relations of a withstand voltage of a dielectric layer of fluorinated silicon oxide which has absorbed water, and an electric capacitance between bus electrodes in the dielectric layer to a film thickness of the dielectric layer. This dielectric layer corresponds to the first dielectric layer of this embodiment, and formed on a glass substrate by the plasma TEOS as similarly to the first dielectric layer. The film thickness, the electric capacitance, and the withstand voltage are measurable by a well known technique in the art, for example, on the basis of JIS. The electric capacitance "C" can be obtained by measuring a current "I" flowing between the bus electrodes 2*b* while applying a sinusoidal voltage therebetween with a frequency "f"=1 kHz, and by calculating it with the following formula: $I=\omega CV$ (wherein $\omega=2\pi f$). If the film thickness of the dielectric layer is too thin, the withstand voltage is not sufficient. If the film thickness is too thick, the electric capacitance becomes low, and therefore the wall charge is not sufficiently formed during the address discharge. Thus, the thickness of the first dielectric layer 4 is preferably not less than about 5 μm and not greater than about 25 μm.

In the context of the present specification, the "thickness" or the "film thickness" of the layer means a distance between the opposed surfaces of the layer. More specifically, when referred to for the first dielectric layer, it means a distance between the position contacting with the glass substrate and the position contacting with the second dielectric layer; when referred to for the second dielectric layer, it means a distance between the position contacting with the first dielectric layer and the position contacting with the protective layer; when referred to for the total of the firs and the second dielectric layers, it means a distance between the position contacting with the glass substrate and the position contacting with the protective layer.

Second Embodiment

This embodiment relates to an embodiment in which the first dielectric layer contains a fluorine atom(s) and water and this first dielectric layer is formed by the first atmosphere containing fluorine atoms in the form of a fluorine atom-containing deposit and the second atmosphere containing moisture. The process of this embodiment is different from the first embodiment in that this process comprises a preparatory step prior to the step of conducting the CVD method and does not use the fluorine atom-containing gas during the CVD method is conducted. Hereafter, this embodiment is described focusing on the deferent points from the first embodiment, and similar to the first embodiment unless otherwise specified.

At first, in the preparatory step, a fluorine atom-containing gas is introduced into the empty vessel (the CVD chamber) which is to be used for forming the first dielectric layer by conducting the CVD method, and then plasma is generated from this fluorine atom-containing gas. As the fluorine atom-containing gas, at least one gas selected from the group consisting of the fluorinated hydrocarbons, $SF_6$, and $NF_3$ may be used. The conditions for generating the plasma can be selected appropriately depending on a kind of the used gas(es) and so on. In this preparatory step, a fluorine atom-containing substance is deposited on and adheres to the inner wall of the vessel to form a thin film.

Next, a substrate separately prepared (which is made by forming transparent electrodes and bus electrodes on a glass substrate) is located in the vessel. The first dielectric layer is then formed by the CVD method as similarly to the first embodiment except that the $C_2F_6$ gas is not used. In this period, fluorine atoms fly out from the fluorine atom-containing thin film which has been deposited on the inner wall of the vessel by the preparatory step, the first atmosphere containing the fluorine atoms is formed, and the fluorine atoms are introduced into the base layer for the first dielectric layer.

Then, thus obtained substrate is, as in the first embodiment, exposed to the second atmosphere containing moisture so that the base layer contact with the second atmosphere. Thus, the first dielectric layer containing both of the fluorine atoms and the water is formed.

Thereafter, as in the first embodiment, the front panel is obtained by forming the dielectric layer with the PVD method, and further forming the protective layer, and then the PDP is produced by facing the front plate with the rear plate and inserting the discharge gas therebetween.

The first dielectric layer of this embodiment contains the fluorine atoms at a lower level than the first dielectric layer of the first embodiment. If the relative permittivity of the dielectric layer is not required to be decreased so much, it is not necessary to positively add the fluorine atoms to the first dielectric layer by using the fluorine atom-containing gas during the formation of the layer on the substrate by the CVD method as in the first embodiment.

According to this embodiment, since the preparatory step of generating the plasma from the fluorine atom-containing gas is conducted, it is possible to remove the dielectric substance (silicon oxide in this embodiment) which would be deposited on the CVD chamber in the continuous production process. That is, the preparatory step can be understood as the cleaning step. As a result, it can be avoided to cause the problem of degradation of the film quality such as the withstand voltage due to incorporation of particles.

In addition, according to this embodiment, since the second dielectric layer is formed by the PVD method, the second dielectric layer functions as the barrier against the fluorine atoms and the water between the first dielectric layer and the protective layer, and thereby it is effectively suppressed that the fluorine atoms and the water contained in the first dielectric layer are diffuses into the protective layer through the second dielectric layer. Therefore, the protective layer made of MgO is free from the bad influence by the fluorine atoms, and thereby it becomes possible to substantially avoid the problems such as increase of the discharge voltage and increase of variation in a delay time of the discharge.

Although the two embodiments of the present invention are described as above, these embodiments may be modified in various ways.

In the first and the second embodiments, the first dielectric layer and the second dielectric layer are both mainly composed of silicon and oxygen atoms. However, the present invention is not limited to this, and the first dielectric layer and the second dielectric layer may be composed of any constituent atoms independently from each other. For example, since the film thickness of the second dielectric layer may be smaller than that of the first dielectric layer, the second dielectric layer can be composed of any dielectric material which is chemically stable and able to prevent the diffusion of the fluorine atoms and the water and transmit a visible light at that thickness. Such material may comprise metal oxides such as a thin film of alumina. For such material, noncrystalline or amorphous materials are suitable compared with crystalline materials in which the fluorine atoms and the water tend to diffuse along a crystal grain boundary.

Also in the first and the second embodiments, the first dielectric layer contains both of the fluorine atoms and the water. However, the present invention is not limited to this, and the first dielectric layer may contain no water. The fluorine atoms and the water contained in the dielectric layer affect independently from each other, and the effect of decreasing the relative permittivity of the first dielectric layer and the effect of decreasing the resistance of the transparent conductive film can be obtained, respectively. Thus, the first dielectric layer containing the fluorine atoms provides the effect of decreasing the relative permittivity of the first dielectric layer, irrespective of whether the first dielectric layer further contains water or not.

Also in the first and the second embodiments, the first dielectric layer containing the water and the fluorine atoms is formed by utilizing the hygroscopicity of the fluorine atom-containing base layer which has been formed by using TEOS. However, any fluorine atom-containing base layer having a hygroscopicity can be used to form the first dielectric layer which further contains water. Although the fluorine atom-containing base layer formed by using TEOS is the most preferable, a fluorine atom-containing base layer formed by using $SiH_4$ also shows a hygroscopicity and is usable.

Furthermore, the present invention may be conducted by combining the preparatory step of the second embodiment with the first embodiment.

What is claimed is:

1. A plasma display panel filled with a discharge gas between a front plate and a rear plate opposed to each other, wherein the front plate comprises:

a glass substrate;

electrodes on the glass substrate;

a first dielectric layer covering the electrodes and the glass substrate and containing a fluorine atom;

a second dielectric layer covering the first dielectric layer and containing a fluorine atom at a less amount than that in the first dielectric layer; and a protective layer covering the second dielectric layer.

2. The plasma display panel according to claim 1, wherein the first dielectric layer further contains water.

3. The plasma display panel according to claim 1, wherein silicon and oxygen atoms accounts for 90% or more of constituent elements of each of the first dielectric layer and the second dielectric layer.

4. The plasma display panel according to claim 1, wherein each of the first dielectric layer and the second dielectric layer contains silicon and oxygen atoms, and when a fluorine atom content in each of the first dielectric layer and the second dielectric layer is measured as a ratio $R_1$ of an intensity of an Si—F bond to that of an Si—O bond obtained by Fourier transform infrared spectrophotometer, a value of the $R_1$ is not smaller than 0.2 and not greater than 5 for the first dielectric layer, and is smaller than 0.2 for the second dielectric layer.

5. The plasma display panel according to claim 2, wherein when a water content in each of the first dielectric layer and the second dielectric layer is measured as a degassing volume of water molecules obtained by Thermal desorption spectroscopy, a ratio $R_2$ of the degassing volume of the first dielectric layer to that of the second dielectric layer is not smaller than 10 and not larger than 1000.

* * * * *